US005672117A

United States Patent [19]

Dar

[11] Patent Number: 5,672,117

[45] Date of Patent: Sep. 30, 1997

[54] ARTICULATED PUTTER WITH SIGHTING DEVICE

[76] Inventor: Ather R. Dar, 98-831A, Kaonoai St., Aiea, Hi. 96701

[21] Appl. No.: 601,929

[22] Filed: Feb. 15, 1996

[51] Int. Cl.[6] ..... A63B 69/36; A63B 53/16

[52] U.S. Cl. ..... 473/232; 473/240; 473/229; 473/254; 473/267; 473/268; 473/294; 473/313; 473/314

[58] Field of Search ..... 473/229, 232, 473/238, 240, 254, 267, 268, 294, 295, 298, 313, 314

[56] References Cited

U.S. PATENT DOCUMENTS 3,485,497 12/1969 Wilks ..... 473/267

5,127,650 7/1992 Schneller ..... 473/294 X 5,188,361 2/1993 Coombe ..... 473/294

*Primary Examiner*—George J. Marlo

*Attorney, Agent, or Firm*—John E. Halamka

[57] ABSTRACT

A golf putter club having a stationary grip portion hingedly mounted to a swingable shaft portion. A head mounted at its center of gravity to the remote end of the shaft. An alignment mark visible to the user engraved on the top surface of the head perpendicular to the face of the head. A sighting device is mounted on the stationary grip whereby, upon placing the face next to the ball, the user may align a preselected target with said alignment mark assuring the face to be perpendicular to the target. While holding the stationary portion, thereby keeping the face aligned, the user may move the swingable shaft portion to impart a pendulum action force to the ball to drive the ball toward the target.

9 Claims, 4 Drawing Sheets

ARTICULATED PUTTER WITH SIGHTING DEVICE

BACKGROUND OF THE INVENTION

1. Background of the Invention

This invention relates to the field of sports equipment and more particularly to a hinged putting device, the lower part being hingedly movable for striking the ball and the upper part being stationary and which incorporates an alignment device.

2. Description of the Prior Art

In prior solutions, others have attempted to provide a pendulum action putter. The pendulum action being desired to achieve the straight back, straight forward and straight follow through action long taught as the preferred putting technique to achieve the desired travel of the ball.

Many of these solutions have sought to incorporate a handle which requires the user to adapt to a an unconventional gripping of the putter such as providing a special rotatable handle mounted parallel with the putting head as taught by U.S. Pat. Nos. 5,209,475 and 4,252,317. Both of these solutions require the rotation of the hand from the conventional vertical grip to a horizontal grip. This rotation may cause forward movement in the user's left elbow. As part of the alignment function of the user's body, conventional golf teaching of the desired putting technique incorporates the pointing of the left elbow at the target or along the desired initial line of travel of the ball to compensate for any undulations in the green.

U.S. Pat. No. 4,491,323 teaches the mounting of a rotatable finger and thumb handle to achieve a fulcrum point. This again requires rotation of the hand from the conventional grip to a new orientation. Further, the pinch grip may be difficult for some user's who lack sufficient strength or to which a pinch grip may be painful.

Prior solutions of mounting an alignment device onto a putter range from a simple scribed line of U.S. Pat. No. 4,659,083 to an intricate mirrored device such as U.S. Pat. No. 4,953,866. These have taught the placement of the sighting device on the head of the putter. When the normal swinging of the putter is used for stroking of the ball, the sighting device is moved out of alignment with the user's field of view and the speed of the stroke makes continuous sighting by the user impossible.

Thus there has long been a need for an arrangement utilizing the conventional putter grip orientation and a sighting device which stays stationary during the putter stroke.

It is desired that a sighting mechanism be incorporated into the putting device.

It is further desired that the device have a portion which is stationary during the putting stroke. The sighting device is mounted on this stationary portion.

It is desired that the non-stationary portion of the device incorporate the motion of a pendulum, the path being aligned with the stationary sighting device. Thus, during the impacting of the ball the head of the putter imparts the desired force to the ball along the line of sight selected by the user.

It is desired that the device utilize the normal grip of a golf club.

SUMMARY OF THE INVENTION

Accordingly, it is an object of the present invention to provide an improved putter having a sighting device which is mounted on a platform held stationary by the user during the putting stroke.

It is another object that the non-stationary portion of the device have a pendulum swinging motion in alignment with the sighting device.

It is yet another object to utilize the standard golf grip position on the club.

The above and other objects of the present invention are achieved, according to a preferred embodiment thereof, by providing an improved hinged putter. In the preferred embodiment the hinge is mounted in the shaft of the club. The portion above the hinge remains stationary during the stoke. The portion below the hinge swings in a pendulum arc during the stroke.

In the preferred embodiment, the addition of a sighting device which is mounted on the stationary portion of the club allows the user to initially align the desired direction of the stroke and keep the club face in this alignment during the execution of the stroke. The stroke is executed with only one hand by movement of the hinged portion of the putter to an arc position depending upon the preselected amount of force deemed necessary by the user to propel the ball toward the desired target. The user may simply release the lower hinged portion and let it swing as an unpowered pendulum or continue to grip the lower portion and execute a swing thus enabling the user to apply additional force to the pendulum motion of the club as the user deems necessary. As either of these movements and execution of the stroke can be accomplished without the user taking eyes off the target, the putter head or the golf ball, the direction of swing will be accurately imparted by the putter head to the ball.

BRIEF DESCRIPTION OF THE DRAWINGS

The above and other embodiments of the present invention may be more fully understood from the following detailed description, taken together with the accompanying drawing, wherein similar reference characters refer to similar elements throughout, and in which.

DESCRIPTION OF A PREFERRED EMBODIMENT

Figure 1:
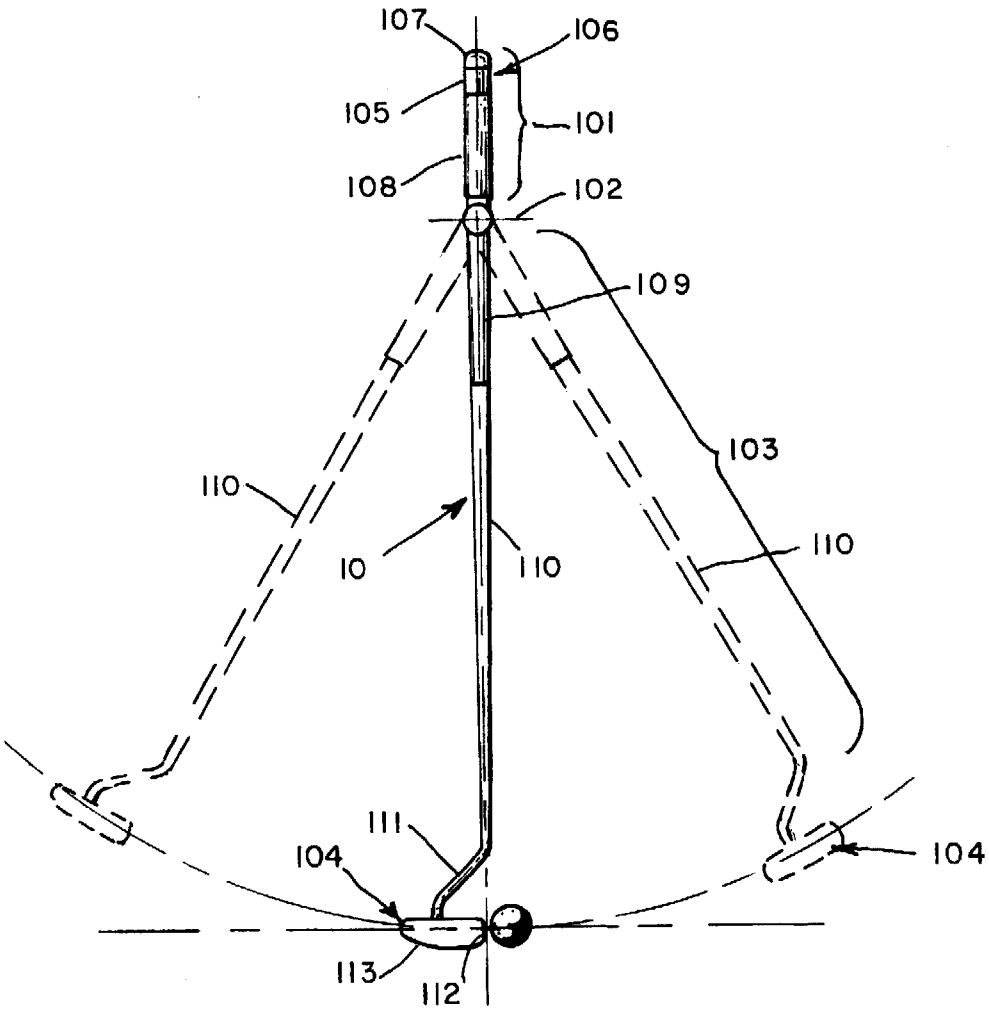
FIG. 1 is a front plane view of the putter.

Referring now to the drawing, FIG. 1 shows the putting club, generally nominated 10, constructed according to the teaching of the invention.

The stationary handle 101 may be shaped to allow the user to comfortably hold the putter 10 by placing a hand in the usual putting position on vertical grip 108 or rotating the wrist to hold the putter 10 by the horizontal grip 107. The handle 101 may be shaped to conform to the palm of the user and may be wrapped with material to increase the comfort and sureness of the grips. The goal is to allow the golfer to hold this portion of the putter 10 stationary without unduly stressing the hand, the wrist and the arm.

The swingable portion 103 is attached to the handle 101 by a hinge 102 which allows movement of the swingable portion 103 in a smooth arc while being restricted to one plane, parallel to the front of the user. No movement of the swingable portion 103 away or toward the front plane of the user should be allowed.

The swingable portion 103 of the putter 10 has a stroke grip 109 for the user to rotate the swingable portion 103 about the axis of the hinge 102. A shaft 110 extending down from the stroke grip 109 at a preselected angle is generally decreasingly tapered and of a length to allow the alignment of the sighting device 105 with a selected portion of the head 104.

A head mounting bracket 111 is attached to the portion of the shaft 110 remote from the stroke grip 109. The bracket 111 is designed to be attached as close as practical to center of mass of putter head 104.

The vertical axis 116 of the swingable portion 103 is aligned with the face 112 of the putter head 104.

The putter head 104 is formed with a rounded bottom edge 113. The rounded shape assists in allowing the swingable portion 103 to complete a back, down and follow through stroke without engaging the ground. The face 112 is generally shaped to be vertical.

Figure 3:
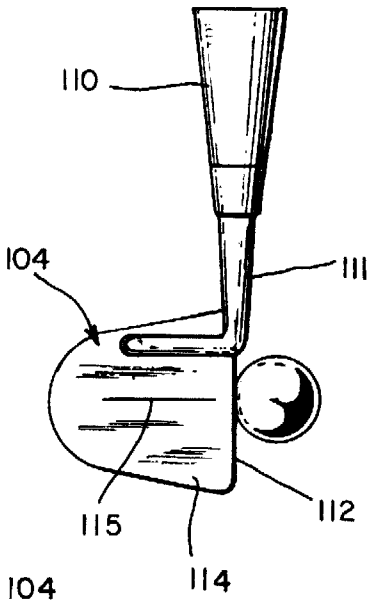
FIG. 3 is a partial top view of the putter head.

As illustrated in FIG. 3, a mark usually formed as a straight line for alignment 115 may be etched in the surface of the top edge 114 of the putter head 104 at a position visible to golfer and preselected to indicate the optimum strike point on the putter face 112 in the direction parallel to the swing.

Figure 2:
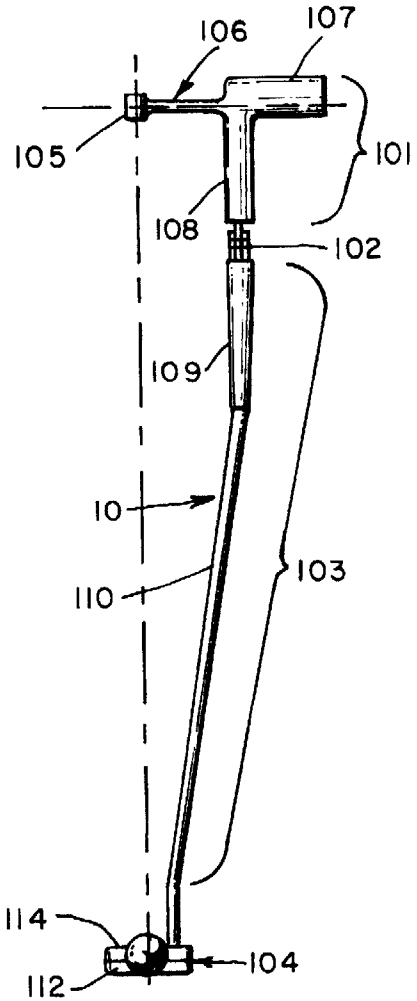
FIG. 2 is a side plane view of the putter.

As illustrated in FIG. 2, the sighting device 105 is an optical device firmly attached to the stationery handle 101 by an offset 106 at a position and distance to align the sighting device 105 with the face 112 of the putter head 104. The offset 106 is positioned to allow the user to look straight down at the ball on the ground through the sighting device 105.

Figure 4:
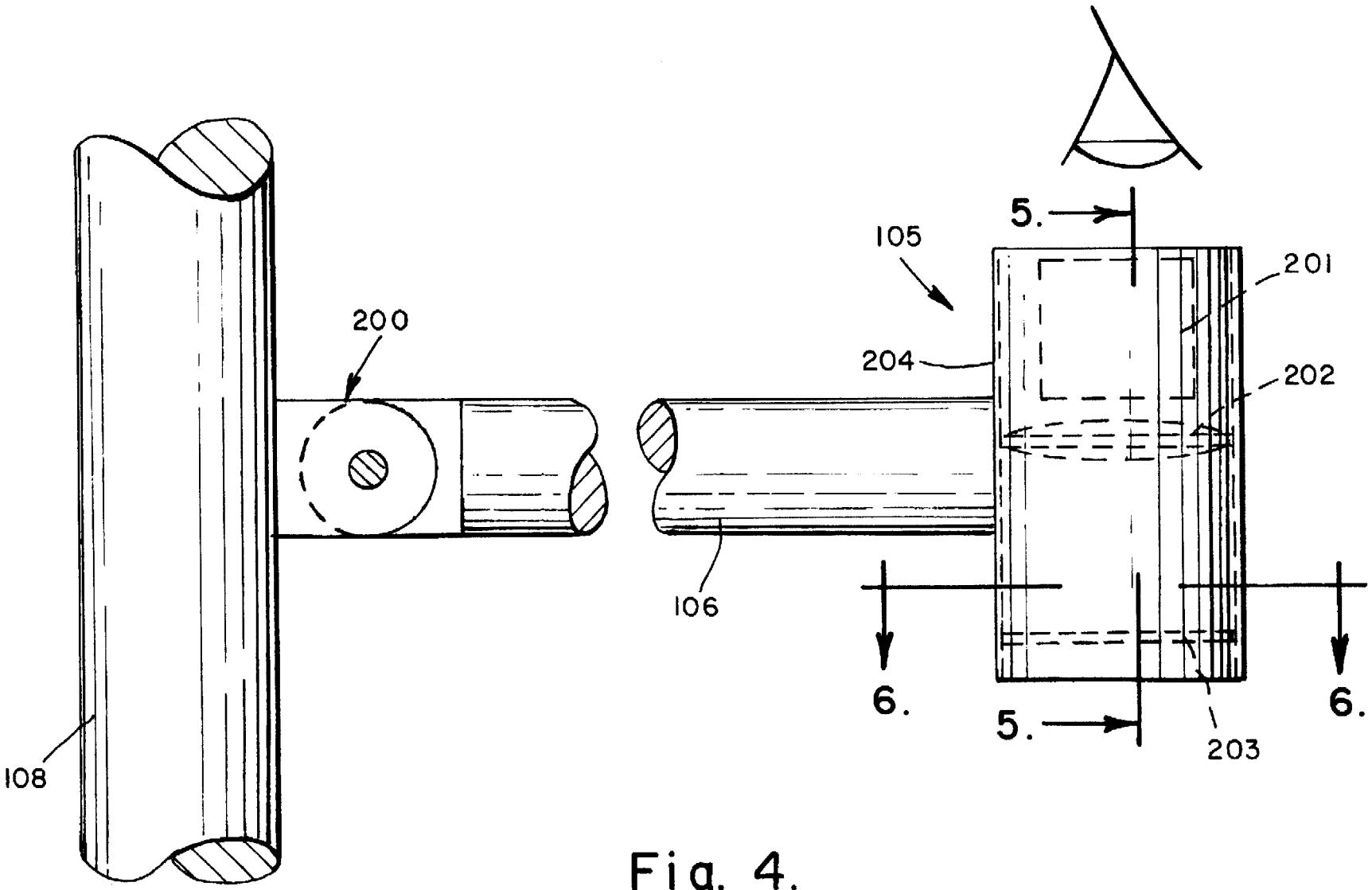
FIG. 4 is a side plane view of the sighting device.

Now referring to FIG. 4, the sighting device generally designated 105, is mounted on the end of offset 106.

The sighting device 105 projects an image of the target 205 such as the cup on the green onto the alignment mark 115. Thereafter the user may move the swingable portion 103 to cause the putter head 104 to strike a golf ball. Since the sighting device 105 is attached to the stationery handle 101, the movement of the swingable portion 103 to strike the ball will still allow the golfer to maintain his line of sight on the target.

Offset 106 is mounted on vertical grip 108 and may incorporate a spring loaded hinge 200 so that the sighting device 105 may be folded out of the way before the putter is placed into the user's golf bag along with all of the other clubs.

A protective sleeve may be used as a separate channel in the user's golf bag for the placement of the putter therein thereby protecting the sighting device 105 and allowing the hinged club to be placed straight in and pulled straight out of the golf bag without entanglement with other clubs in the bag.

A barrow 204 forms the body of the sighting device 105. A right angled prism 201 is mounted in the barrow and aligned to have a field of view perpendicular to the face 112 of the putter so that the target 205 of the putting stroke will be visible to the user looking down the barrow 204.

A projection surface 203, of half mirrored or simple glass, is mounted in the base of the barrow 204. A preselected lens 202 may be mounted in the barrow 204 to assist the user in seeing the alignment mark 115 on the putter head 104.

Figure 5:
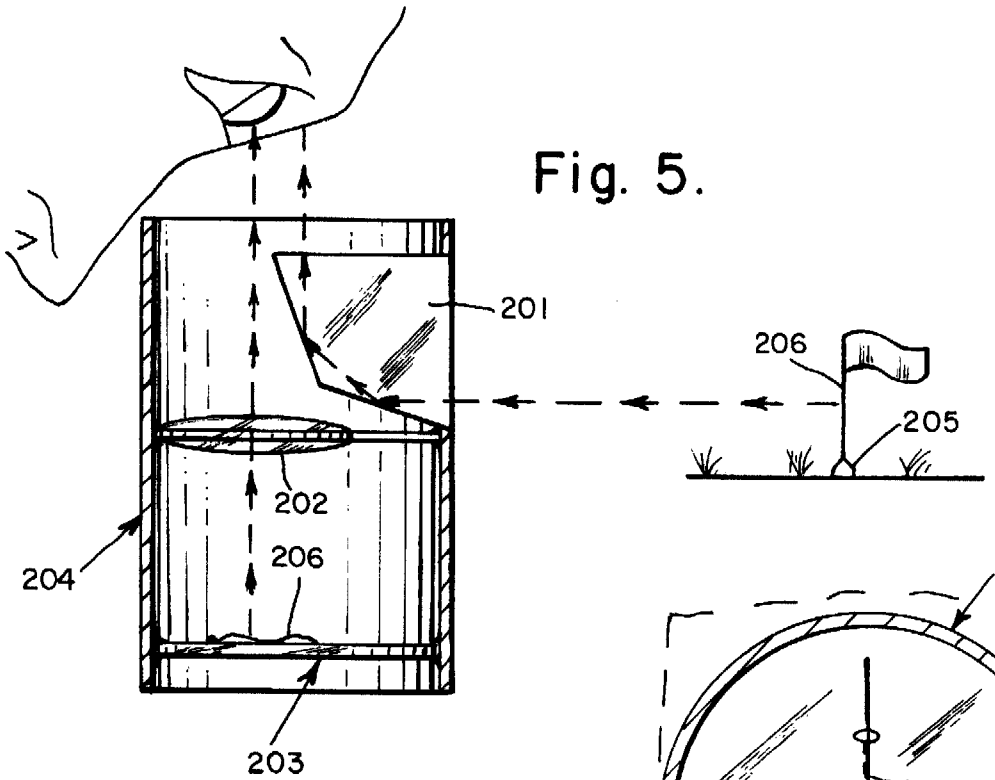
FIG. 5 is a cross-sectional view of the sighting device at AA.
Figure 6:
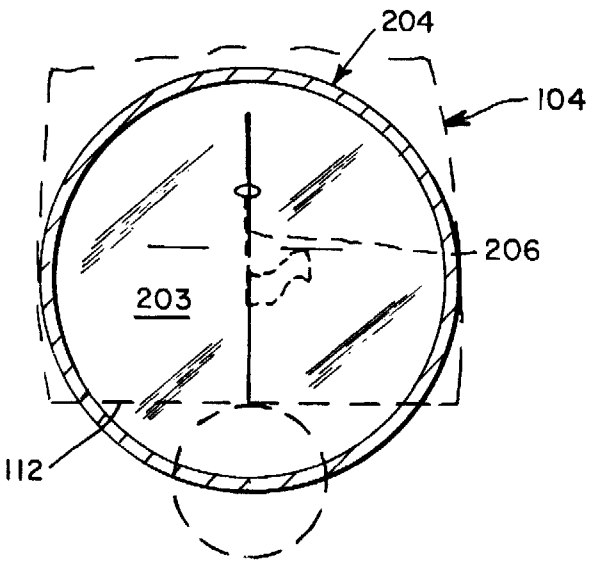
FIG. 6 is a cross-sectional view of the sighting device at BB.

FIG. 5 illustrates the sighting of the target by moving the putter 10 so that the virtual image of the target 206 appears. The user continues to adjust the putter to a position whereby the virtual image of the target 206 is coincident with the alignment mark 115, as shown in FIG. 6. Upon completion of alignment, the face 112 of the putter 10 is perpendicular with the target 205 and the alignment mark 115 is pointed directly on line with the target 205.

The user need only grasp the stroke grip 109, and move it so as to rotate the putter head 104 around the axis of the hinge 102 a preselected distance. The user may simply release the stroke grip and allow the pendulum action of the swingable portion 103 to impart a force on the ball thereby driving the ball to the target 205 or the user may chose to execute a normal putting swing to impart additional force on the ball while keeping the club 10 in alignment.

Figure 7:
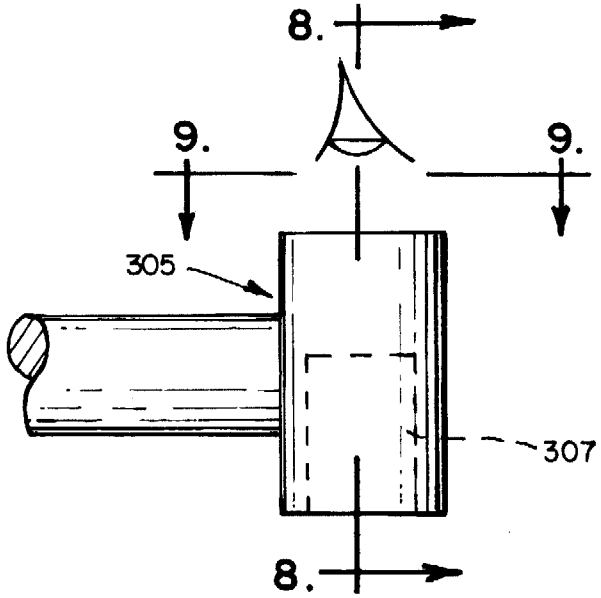
FIG. 7 is a perspective view of another embodiment of the sighting device

FIG. 7 illustrates another embodiment of the sighting device generally nominated 305.

The sighting device is mounted on the end of a hinged offset 106 as above in a position of optical and physical congruency with the alignment mark 115.

Figure 8:
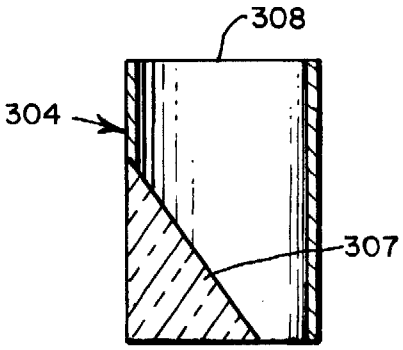
FIG. 8 is a cross-sectional view of the other sighting device at AA.

FIG. 8 illustrates a mirror 307 mounted in an oblong cross-sectional shaped barrow 304 at a position to allow the user to see directly through a portion of the barrow 304 to the head 104 below. The portion of the barrow 304 directly across from the mirror 307 may be transparent or formed as an opening to allow the target 205 to be viewed in the mirror 307. A cross hair 308 is mounted on the barrow 304 above the mirror 307.

Figure 9:
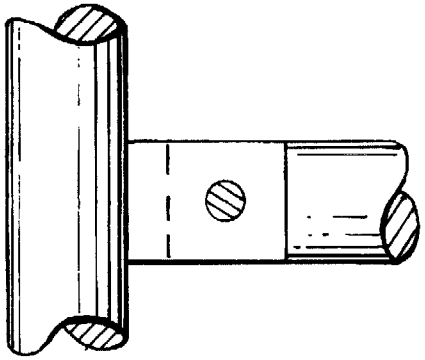
FIG. 9 is a cross-sectional view of the other sighting device at BB.
Figure 9:
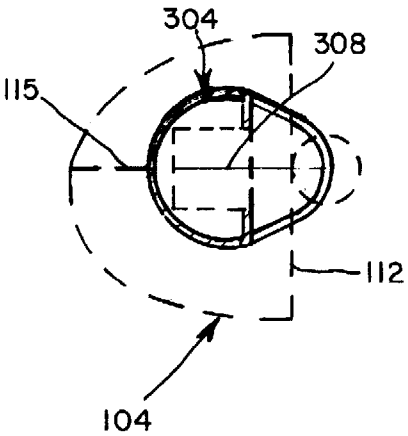

While addressing the ball for putting the ball to the target 205, FIG. 9 illustrates what the user will see upon looking into the sighting device 305. The user will adjust the putting club 10 until the target is in view on the mirror 307 and aligned under the cross hair 308. The alignment mark 115 is visible through a portion of the barrow 304. Upon the condition of the user viewing the coincidence of the remainder of the cross hair 308 with the alignment mark 115, the face 112 of the head 104 is perpendicular with the target 205. The user need only operate the swingable portion 103 of the putting club 101 to drive the ball toward the target 205.

Since certain change may be made in the above apparatus without departing from the scope of the invention herein involved, it is intended that all matter contained in the above description, as shown in the accompanying drawing, shall be interpreted in an illustrative, and not a limiting sense.

What is claimed is:

1. A golf ball putting club comprising in combination:

a stationary handle;

a sighting device mounted on said stationary handle;

a hinge;

a swingable portion mounted to said stationary handle by said hinge;

a mounting bracket attached to the end of said swingable portion remote from said hinge;

a head, having a face and an alignment mark perpendicular to said face formed in the top of said head, said head mounted on said mounting bracket so that under the condition of the user placing said face against said ball, viewing through said sighting device and adjusting the position of said stationary handle so that said alignment mark is coincident with a user selected target displayed in said sighting device, the face of said head is aligned perpendicular to said target whereby the user may move said swingable portion through a preselected arc around said hinge and release or push said swingable portion to impart a force to said ball along the line of sight selected through said sighting device.

2. The golf ball putting club defined in claim 1 wherein:

said swingable portion further comprised, in combination;

a stroke grip mounted below said hinge;

a shaft mounted at a preselected angle to said stroke grip remote from said hinge, said shaft being tapered to a decreasing diameter remote from said stroke grip.

3. The golf ball putting club defined in claim 1 wherein:

said head is attached to said mounting bracket at the center of gravity of said head.

4. The golf ball putting club defined in claim 1 wherein:

said stationary handle further comprised, in combination;

a vertical portion allowing the user to grasp the club in the normal grip position; and a horizontal portion mounted to the top of said vertical portion allowing the user to grasp the club in a rotated grip position.

5. The golf ball putting club defined in claim 1 further comprising;

an offset mounting having one end mounted to said stationary handle, the other end adapted for mounting of said sighting device in alignment with said face;

said sighting device further comprised, in combination;

a barrow attachable to said offset;

a right angled prism mounted inside said barrow whereby the user may look down said barrow and observe an image of a user selected target;

a viewing screen mounted in said barrow below said prism through which the user may observe said alignment mark.

6. The golf ball putting club defined in claim 5 further comprising;

a lens mounted in said barrow to allow the user ease in viewing said alignment mark.

7. The golf ball putting club defined in claim 5 wherein said offset mounting may be hinged to allow said sighting device to be folded against said club before said club is placed in a golf bag by the user.

8. The golf ball putting club defined in claim 1 further comprising;

an offset mounting having one end mounted to said stationary handle, the other end adapted for mounting of said sighting device in alignment with said face;

said sighting device further comprised, in combination;

an oblong barrow attachable to said offset, a portion of said barrow having an opening or fabricated of transparent material;

a mirror mounted inside said barrow opposite said opening or transparent material whereby the user may look down said barrow and observe an image of a user selected target in said mirror, said mirror being of a preselected size to allow the user to observe the alignment mark through said barrow;

a cross hair mounted on said barrow above said mirror whereby under the condition of adjustment of position of said club, the user may align under said cross hair a preselected target displayed on said mirror and said alignment mark thereby positioning said face perpendicular to said target.

9. The golf ball putting club defined in claim 8 wherein said offset mounting may be hinged to allow said sighting device to be folded against said club before said club is placed in a golf bag by the user.

* * * * *